US010858908B2

(12) United States Patent
Ladrón de Guevara

(10) Patent No.: US 10,858,908 B2
(45) Date of Patent: Dec. 8, 2020

(54) CHECK VALVE WITH INTERNAL MASS FOR PROGRESSIVE CAVITY PUMPS

(71) Applicant: SERINPET—REPRESENTACIONES Y SERVICIOS DE PETROLEOS, Bogota (CO)

(72) Inventor: Alejandro Ladrón de Guevara, Bogota (CO)

( * ) Notice: Subject to any disclaimer, the term of this patent is extended or adjusted under 35 U.S.C. 154(b) by 267 days.

(21) Appl. No.: 15/037,706

(22) PCT Filed: Nov. 19, 2014

(86) PCT No.: PCT/IB2014/066144

§ 371 (c)(1),
(2) Date: Feb. 6, 2017

(87) PCT Pub. No.: WO2015/075636

PCT Pub. Date: May 28, 2015

(65) Prior Publication Data

US 2017/0122067 A1 May 4, 2017

(30) Foreign Application Priority Data

Nov. 19, 2013 (CO) ..... 13271804

(51) Int. Cl.

| | |
|---|---|
| ***E21B 34/08*** | (2006.01) |
| ***E21B 43/12*** | (2006.01) |
| ***F04C 13/00*** | (2006.01) |
| ***F04C 15/06*** | (2006.01) |
| ***F04C 14/28*** | (2006.01) |
| ***F04C 2/107*** | (2006.01) |

(52) U.S. Cl.

CPC ..... *E21B 34/08* (2013.01); *E21B 43/126* (2013.01); *F04C 2/107* (2013.01); *F04C 2/1073* (2013.01); *F04C 13/008* (2013.01); *F04C 14/28* (2013.01); *F04C 15/066* (2013.01); *F04C 2270/72* (2013.01)

(58) Field of Classification Search

CPC ..... E21B 34/08; E21B 43/126; E21B 34/12; F04C 13/008; F16K 15/18; F16K 27/0209

See application file for complete search history.

(56) References Cited

U.S. PATENT DOCUMENTS 2,571,497 A * 10/1951 Stewart ..... F04B 53/102 137/512.5

4,332,533 A 6/1982 Spears (Continued)

FOREIGN PATENT DOCUMENTS

CO 5970151 A1 * 10/2008 ..... F16K 17/00

*Primary Examiner* — Blake E Michener
*Assistant Examiner* — Theodore N Yao
(74) *Attorney, Agent, or Firm* — Cotman IP Law Group

(57) ABSTRACT

The present invention corresponds to a check valve with an inertial mass that is installed in the bottom of the production tubing and above the progressive cavity pump (PCP) of an oil well, which prevents that the hydrostatic column that is inside of the production tubing go down in the moment where the artificial lift of the column stops for the detention of the PCP pump. If we prevent that this phenomenon to happen, the PCP pump will not rotate in the opposite direction of its normal operation and it will not be clogged by any particulate material that is contained in it.

13 Claims, 9 Drawing Sheets

(56) References Cited

U.S. PATENT DOCUMENTS

| | | | | |
|---|---|---|---|---|
| 4,576,235 | A * | 3/1986 | Slaughter | E21B 34/10 166/317 |
| 4,767,291 | A * | 8/1988 | Freeman | F04B 47/02 137/102 |
| 6,289,990 | B1 * | 9/2001 | Dillon | E21B 34/08 166/319 |
| 2012/0251337 | A1 | 10/2012 | Freeman | |
| 2015/0107823 | A1 * | 4/2015 | Gronning | E21B 43/127 166/192 |
| 2019/0010782 | A1 * | 1/2019 | Parkins | E21B 34/08 |

* cited by examiner

CHECK VALVE WITH INTERNAL MASS FOR PROGRESSIVE CAVITY PUMPS

FIELD OF THE INVENTION

The present invention is related to the field of mechanical engineering and is applied in the hydrocarbon sector.

Specifically, the present invention it is applied in oil wells where the PCP pumps are used.

BACKGROUND OF THE INVENTION

The patent request number 2006027513 "Improvement System in a fuel pump" has a fuel supply system that includes a fuel pump, a controller, and pulse circuit. The fuel pump has an electric motor that includes a configured winding that operates with a maximum efficacy for a first tension to an expected load. The controller includes a pulse width modulator that generates an electrical signal that activates the electrical motor. In normal operating conditions, the circuit acts as an impulse step and generates the excitation signal that is modulated at the first voltage, to control the output of the pump. However, when a bigger load than the expected is applied to the electric motor, the pulse circuit acts to scale the excitation signal to a second tension that is bigger than the first tension. The second tension drives the electric motor to a tension beyond the maximum efficiency, but generally provides greater efficiency of the system.

On the other hand, the patent application entitled Linear Pump with attenuation of escape pulsations, number 20060034709, describes a linear pump that has an axially aligned cylinder and a piston arrangement driven by an electromagnet motor that has an escape camera that defines a cavity covered by a diaphragm. The diaphragm can be moved into the cavity in response to pressure fluctuations in the escape camera to reduce the pulsations in an air flow that goes out of the escape camera. A diaphragm is mounted over the cavity hollowed by a support ring that has an open center allowing air acts against the diaphragm.

The previously mentioned patents do not achieve an effective optimization for the pumping pumps because the pumps arose from progressive cavities.

Progressive Cavity Pumps (PCP) are machines that spin clockwise in order to lift the oil from the bottom of the well to the surface. For this, is used a machine that is on the surface and that have a motor and a speed reducer, this machine is responsible for providing the necessary rotation and power to move this pump. It also uses a string of rods, which connect the PCP pump rotor with the surface. The measure of this rods are approximately 6 meters, but the drill string, which is the union of various of these rods (dipsticks), can measure between 300 m to 3000 m; these dipsticks transmit the power and rotation of the machine from the surface to the pump. The current problem is that when the PCP pump stops, the hydrostatic column that is above it makes the PCP pump rotate in the opposite direction of its normal operation. In some cases, this causes obstruction of the pump by particulate matter mixed with petroleum extraction, such as sand. This also represents an estimated time delay between one and two hours, because it is impossible to start the PCP pump while it is rotating in the opposite direction of its operation. This unjustified strike represents millions in losses to the industry.

The Colombian patent "Check valve for progressive cavities pumps (PCP)" describes a check valve for a progressive cavity pump (PCP) that seeks to optimize the operation of the PCP but it has not made an effective opposition to the hydrostatic column and it is susceptible of improvement.

In the petroleum production the progressive cavities pumps are normally used and the need to prevent the reverse rotation of this machines persists.

The effective solution of this technical problem could reduce the operative costs of this artificial lift system.

Present invention is developed based on the first valve design that prevents the reverse rotation of the progressive cavity pumps, which with the pertinent adjustments is going to optimize its performance.

DESCRIPTION OF INVENTION

The present invention provides a check valve with an inertial mass which is installed at the bottom of the production tubing and above the PCP pump of the oil well to prevent the hydrostatic column that is inside the production tubing from descending at the moment the artificial lift is suspended as a result of stopping the PCP pump. The result is that the PCP pump does not turn in the opposed direction of its normal function, and that the same one is not clogged because of the particulate matter, such as sand, mixed with petroleum extraction.

The check valve with an inertial mass for progressive cavity pumps is constituted by eight components which are: a superior locknut, a stem, a piston, a piston cover, a nipple, an inferior lock nut, an inner and outer packing. The piston moves axially along the stem and sits on the nipple where it makes the hydraulic seal. When the piston is not seated, it allows the artificial lift of the fluid, and due to its geometry characteristics it's embedded in the superior lock nut which is coupled in the superior left screw of the stem, with the purpose of jointly rotating with the stem. The fact that this check valve for progressive cavity pumps has an inertial mass, refers to the weight that the piston has. The piston's weight improves its descending movement, which guarantees the closing action of the check valve with an inertial mass for progressive cavity pumps.

The check valve with an inertial mass consists of eight main parts: an upper nut 1, a stem 2, a piston 3, a piston cover 4, a nipple 5, a lower nut 6, an inner packing 17 and an outer packing 18, as the FIG. 1 shows. The stem 2 comprises a medium alloy steel shaft that at the ends has threads 8 and 11, besides threads the 9 and 10, as shown in FIG. 3. The upper left-hand thread 9 is located next the upper thread 8 while the lower left-hand thread 10 is located next to the bottom of thread 11. The upper thread 8 connects a coupling that belongs to the string of rods which is connected to a motor with a speed reducer that is situated on the surface of the well. Through a coupling, the lower thread 11 is connected to a rod string which is connected to the PCP's rotor pump. In the lower left-hand thread 10 the lower nut 6 is installed, in order to support the coupling that settles on the thread 11 bottom. The piston 3 comprises an inner groove 13 where is installed with internal packing 17 that retains the fluid between the piston 3 and the stem 2, which can be seen in FIG. 4. It also has a step 14 where the external packing 18 is installed and retains the fluid between the nipple 5 and piston 3, as the FIG. 4 shows. The piston 3 also has a thread 15 which is covered by a piston cover 4, in order to hold and ensure the position of the external packing 18. The piston cover 4 has two parallel flat faces, as the FIG. 5 shows, which serve as a support tool that is used for threading piston cover 4 in the thread 15 of the piston 3. The stem 2 is inserted through the piston 3 and is restricted by the installation of the top lock nut 1 in the upper left thread 9.

The top lock nut 1 is characterized by two wedges 7, as shown in FIG. 2, which couples with the groove wedges 12 of the piston 3. The nipple 5 is installed on the stem below the piston 3 and above the lower nut 6. This nipple 5 has a conical seat 16, as the FIG. 6 shows, where the piston 3 is supported when the check valve with an inertial mass is closed.

The piston design contemplates the enough weight, to achieve descent and overcome the friction that occurs between the inner packing 17 and the stem 2. This ensures that the piston 3 is inserted into the nipple 5 to seal the internal and the external passage of fluids, as the FIG. 9 shows. Additionally, the design of the piston 3 includes the diameter D1 and the diameter D2, as the FIG. 4 shows. The diameter D1 has enough measure so the stem 2 can traverse the piston 3, with a sliding fit. In order to provide a loose fit between the stem 2 rod and the piston 3, the diameter D2 is larger than the diameter D1. With all this, even if the stem 2 has a slight buckling, the system will ensure its operation.

When the well is producing, the piston 3 is lifted to make contact with the upper lock nut 1 where it engages with the wedges 7 of the upper nut 1, as the FIG. 8 shows. When the PCP stops rotating, the piston weight added to the drag action of the fluid belonging to the hydrostatic column will make piston 3 descend to rest on the conical seat 16, as the FIG. 9 shows. In this way, the outer packing 18 makes a seal between the piston 3 and the nipple 5.

LIST OF REFERENCE

Figure 1:
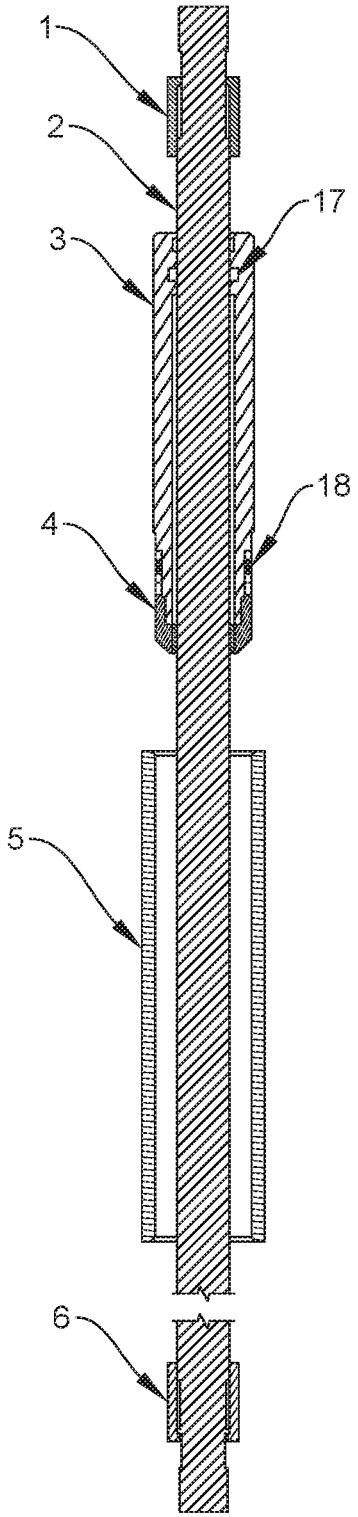
FIG. 1: View of the check valve with an inertial mass for progressive cavity pumps assembled with their respective parts.
Figure 2:
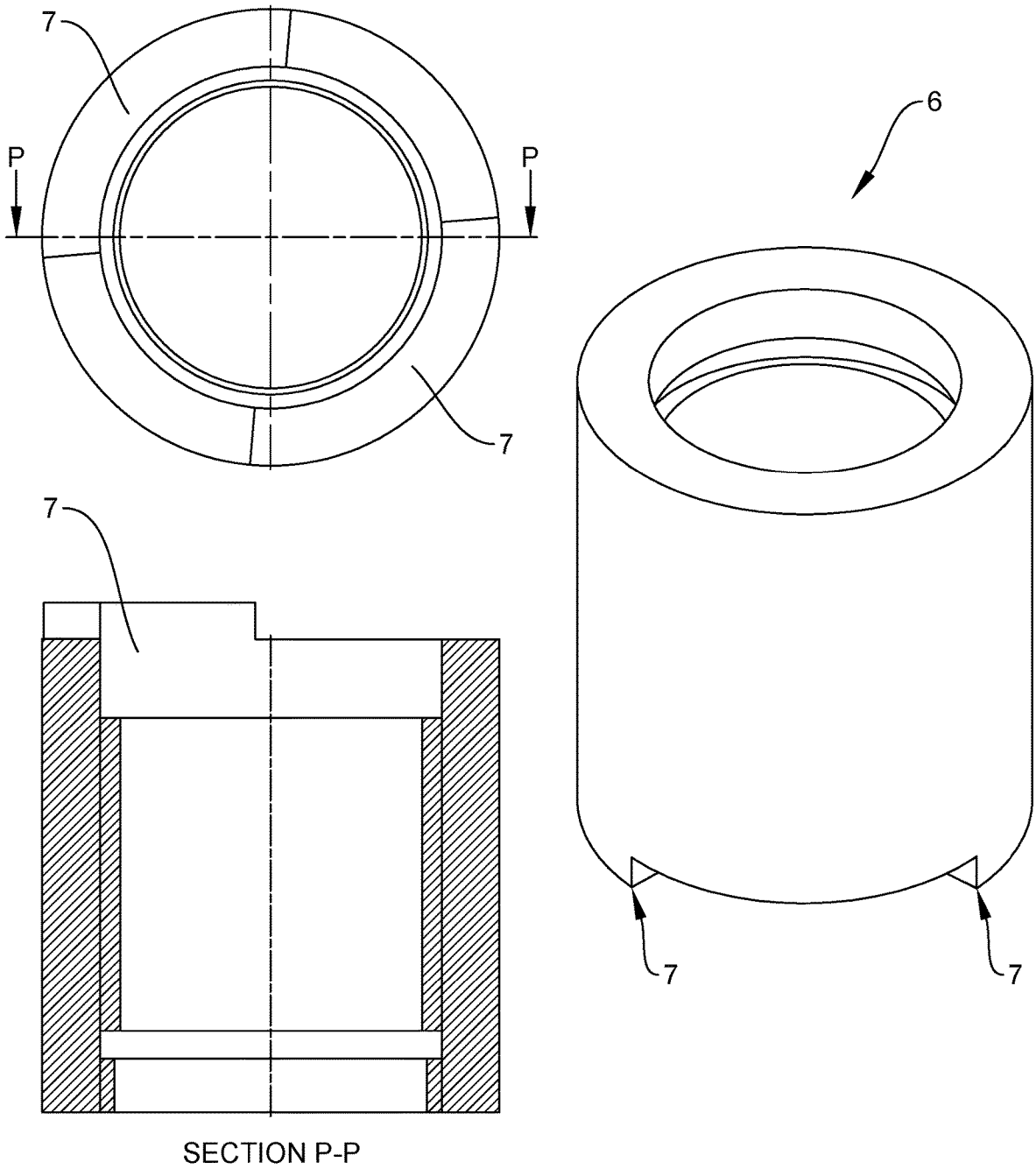
FIG. 2: Views of Top nut 1.
Figure 3:
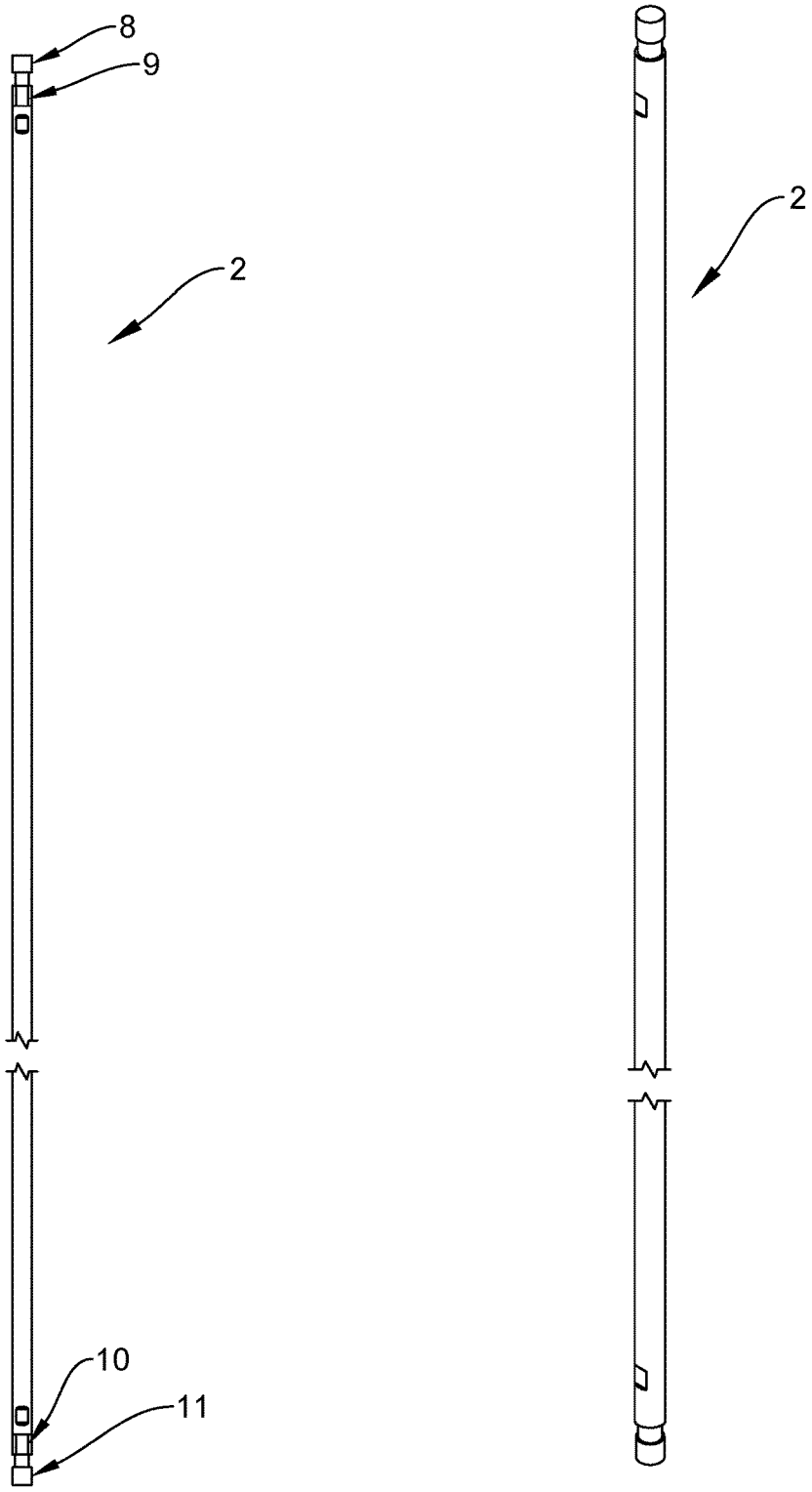
FIG. 3: Views of Stem 2.
Figure 4:
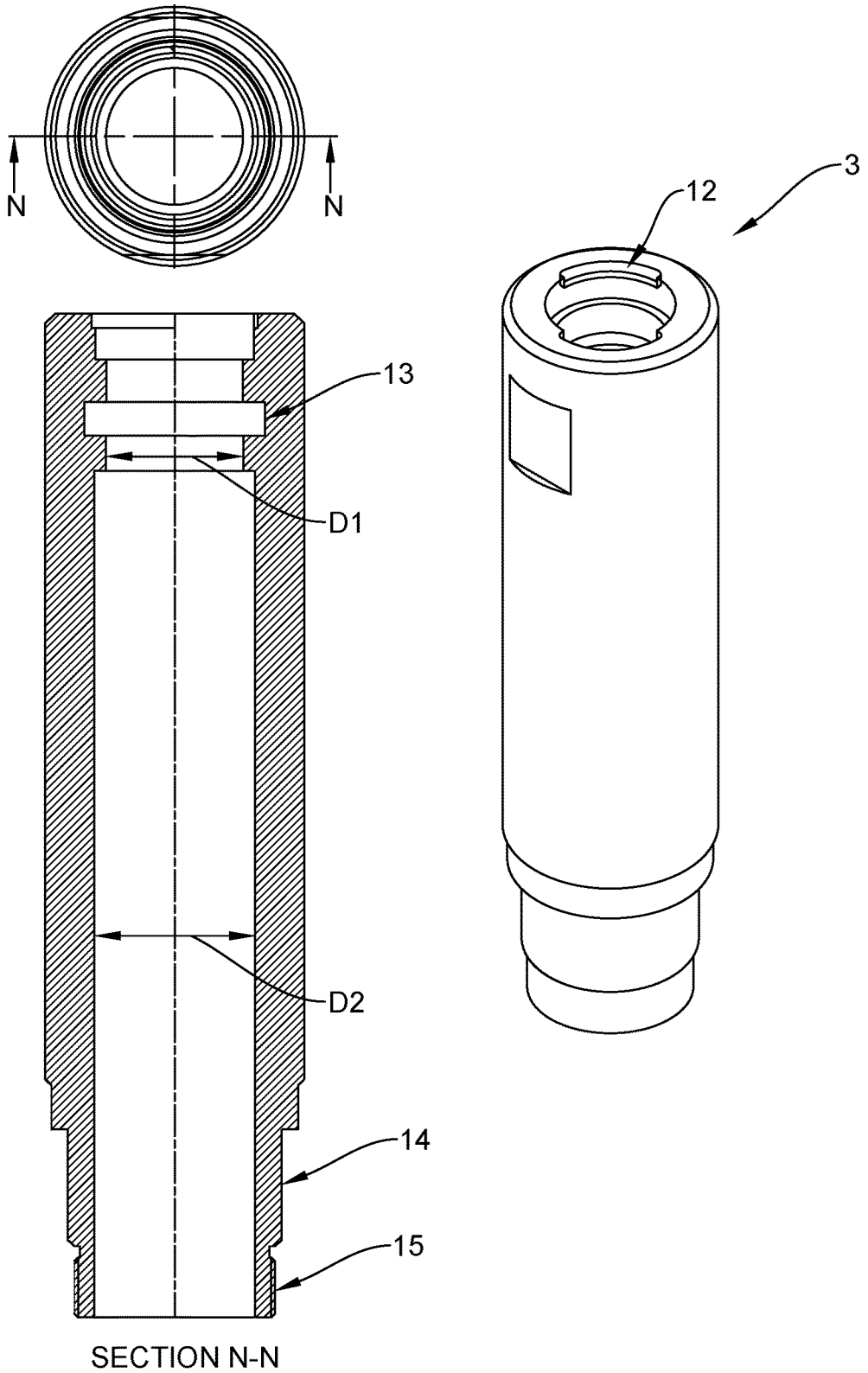
FIG. 4: Views of Piston 3.
Figure 5:
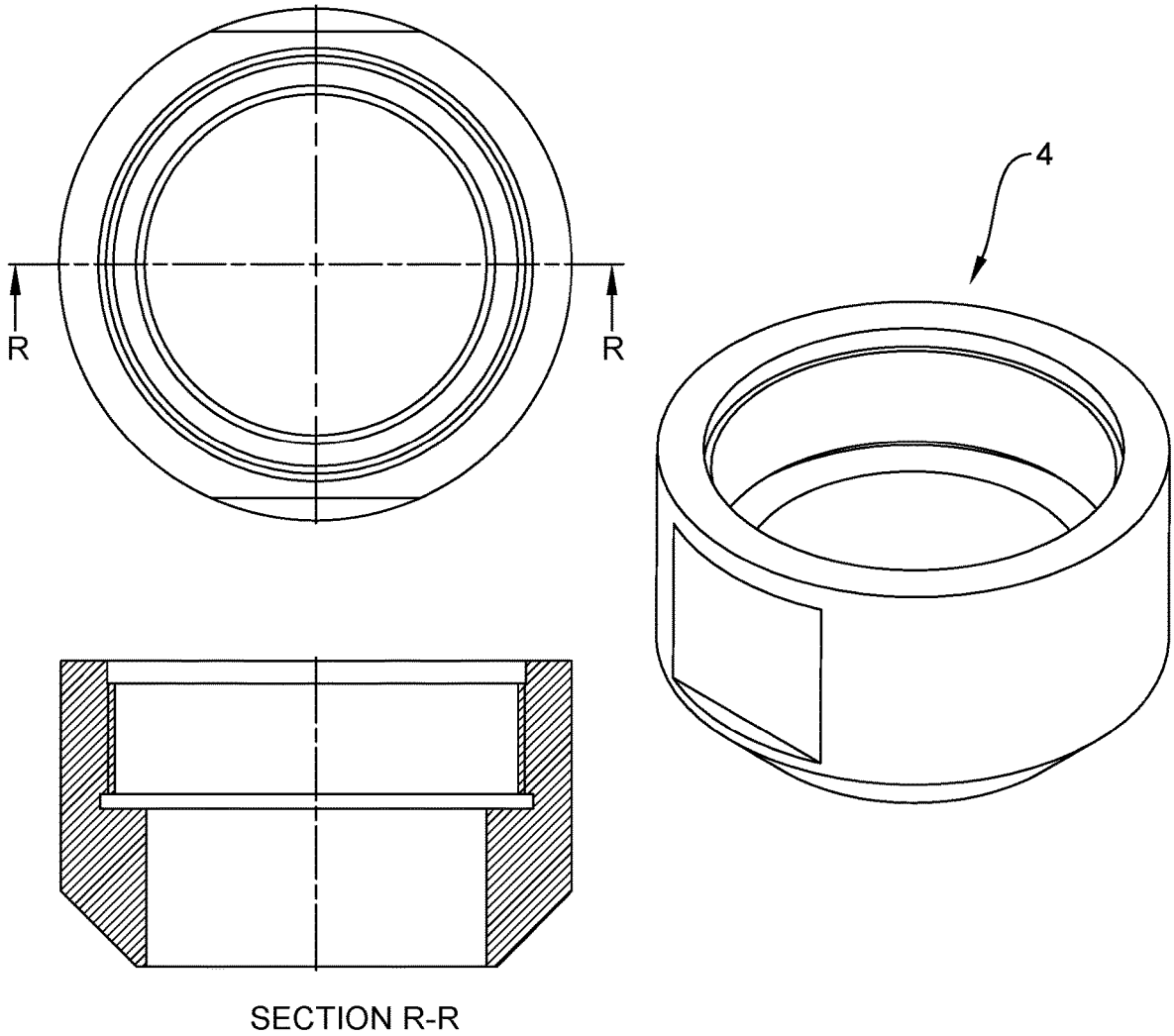
FIG. 5: Views of piston cover 4.
Figure 6:
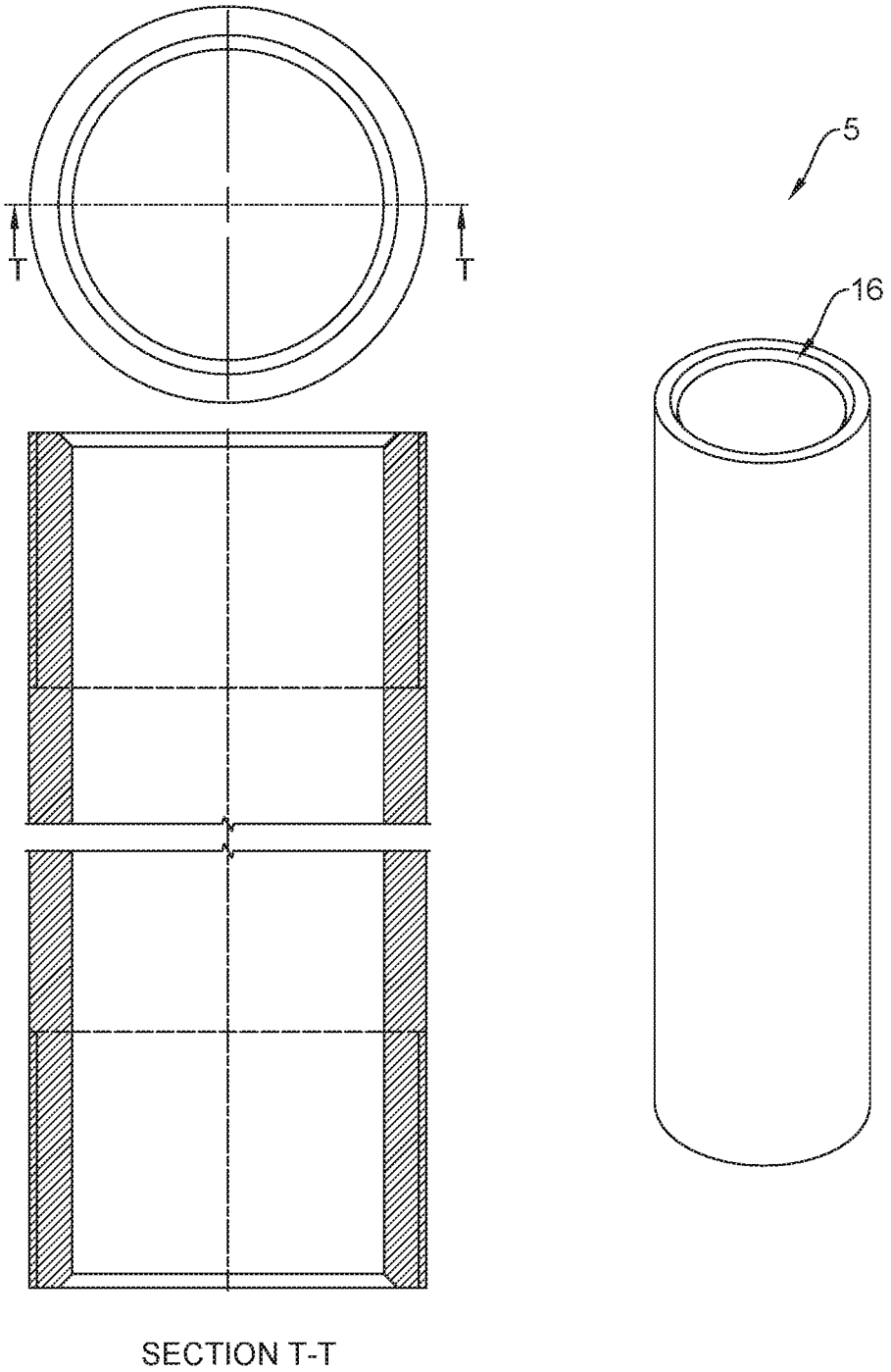
FIG. 6: Views of Nipple 5.
Figure 7:
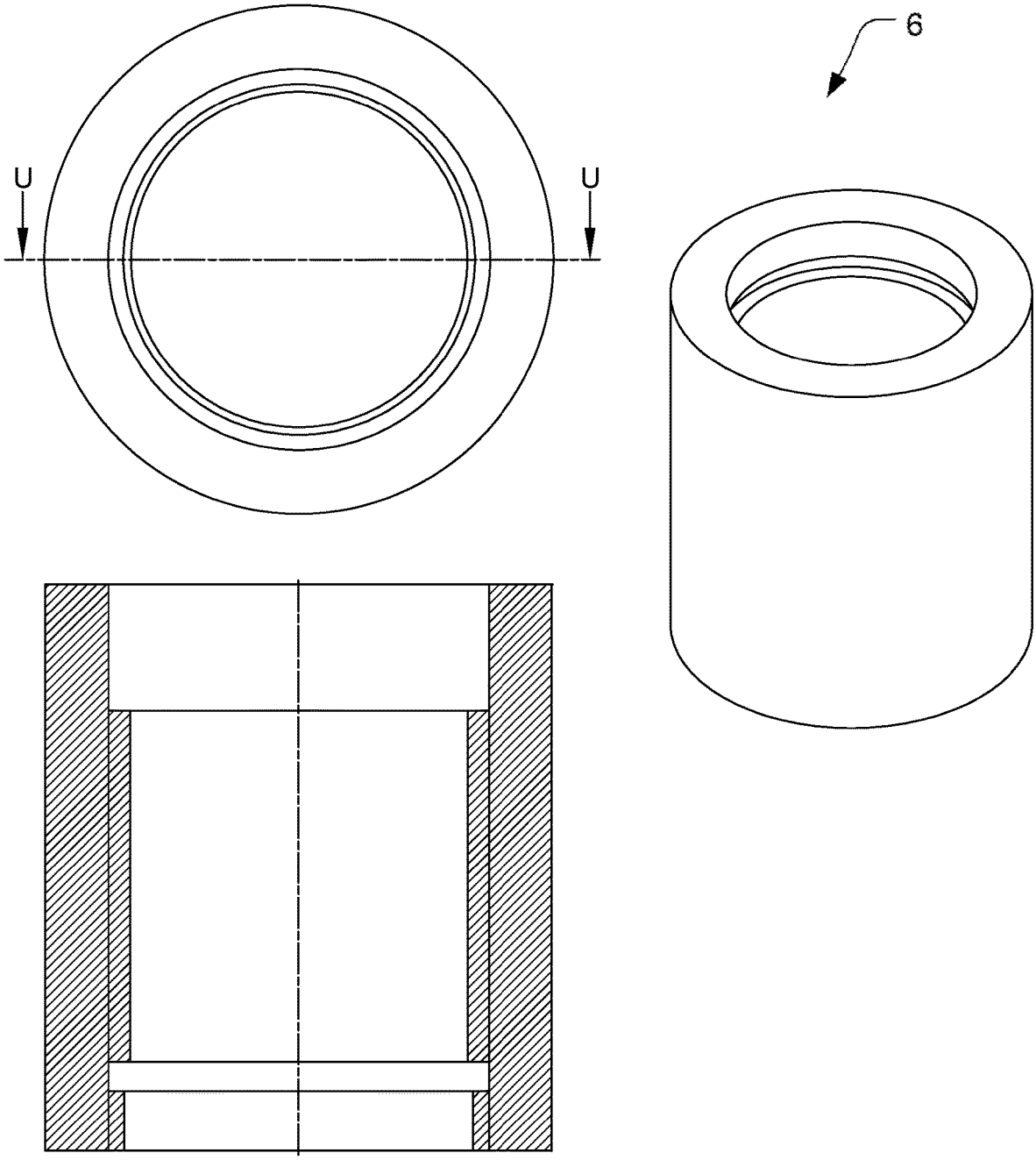
FIG. 7: Views of Lower nut 6.
Figure 8:
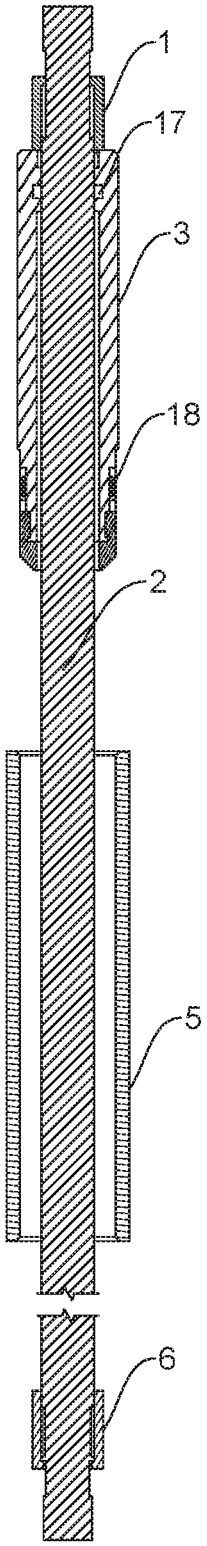
FIG. 8: Perspective view of the check valve with an inertial mass for progressive cavity pumps that is in an open position with the piston 3 embedded in the wedges 7 of the upper nut 1.
Figure 9:
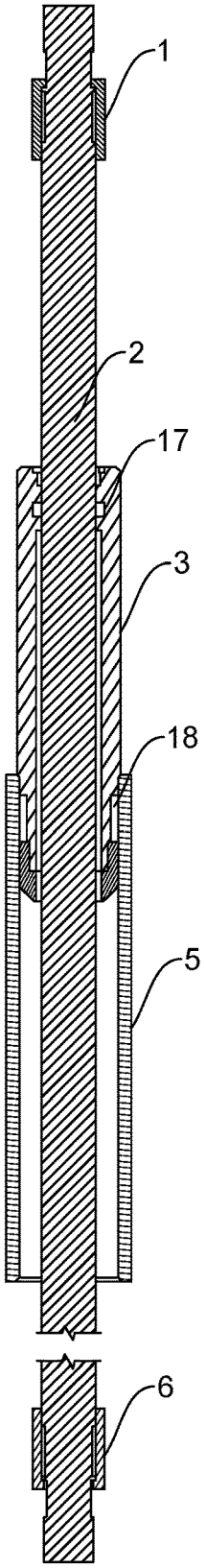
FIG. 9: Perspective view of the check valve with an inertial mass for progressive cavity pumps, in a closed position where the piston 3 is seated on the conical seat 16 o the nipple 5.

1. Top (upper) Locknut.
2. Stem.
3. Piston.
4. Piston cover.
5. Nipple.
6. Lower nut.
7. Wedge.
8. Upper thread.
9. Upper left thread.
10. Lower left thread.
11. Lower thread.
12. Groove wedges.
13. Inside groove.
14. Step.
15. Thread.
16. Conical Seat.
17. Internal packing.
18. External packing.

The invention claimed is:

1. A check valve with an inertial mass for a progressive cavity pump (PCP), comprises:

a stem (2) having a stem top end and a stem bottom end, wherein the stem (2) is configured to be coupleable at the stem top end to a motor and at the stem bottom end to a PCP rotor pump;

an upper lock nut (1) removably coupled to said stem (2) below said stem top end;

a nipple (5) coupled around said stem (2) above said stem bottom end and exposing a fluid passage between said nipple (5) and said stem (2), said nipple (5) having a top end with a seat; and an elongated piston (3) slidably coupled around said stem below said upper lock nut (1) and above said nipple (5), said piston having a first section at a top end of said piston that is configured to engage with said upper lock nut (1) during operation of said motor, said piston further having a short second section abutting and below said first section and having an aperture with a first diameter for a snug fit around said stem thereby providing an internal fluid seal between said piston and said stem, said piston further having an elongated third section abutting and below said second section and extending to a bottom end of said piston, said third section having an axial length that is longer than the second section and an aperture with a second diameter larger than said first diameter for a loose fit around said stem, a cylindrical sealing section positioned externally to said piston having an external diameter configured to slide into and fit snugly inside said nipple (5), said sealing section beginning at the bottom end of the piston and extending upwardly and terminating part-way up the piston on the third section, said third section having a larger external diameter than, and extending radially relative to the sealing section thereby configured as a piston stop when in contact with said seat, wherein said piston (3) is configured to slide up during operation of said motor such that the first section engages with said upper lock nut (1) to cause said piston (3) and said stem (2) to cooperate thereby exposing the fluid passage, and wherein said piston (3) is configured to downwardly slide by gravity into said nipple (5) such that said sealing section of said piston (3) slides into and engages the nipple (5) inside the fluid passage thereby creating an external seal of said fluid passage when said motor is not in operation.

2. The check valve of claim 1, further comprising a lower nut (6) removably coupled to said stem (2) to provide support for coupling a rod string from said PCP rotor pump to said stem (2).

3. The check valve of claim 1, wherein the first section comprises an internal packing material (17) configured to provide the internal fluid seal in said piston (3).

4. The check valve of claim 3, wherein said sealing section comprises an external packing material (18) configured to enhance the external fluid seal thereby preventing fluid from flowing through the nipple (5).

5. The check valve of claim 4, wherein said sealing section comprises a cap for securing said packing material (18).

6. A check valve with an inertial mass for a progressive cavity pump (PCP), comprises:

a stem (2) having a stem top end and a stem bottom end;

an upper lock nut (1) removably coupled to said stem (2) below said stem top end;

a nipple (5) coupled around said stem (2) above said stem bottom end and exposing a fluid passage between said nipple (5) and said stem (2), said nipple (5) having a top end with a seat; and an elongated piston (3) slidably coupled around said stem below said upper lock nut (1) and above said nipple (5), said piston having a first section at a top end of said piston that is configured to engage with said upper lock nut (1) during operation of said motor, said piston further having a short second section abutting and below said first section and having an aperture with a first diameter for a snug fit around said stem thereby providing an internal fluid seal between said piston and said stem, said piston further having an elongated third section abutting and below said second section and extending to a bottom end of said piston, said third section having an axial length that is longer than the second section and an aperture with a second diameter larger than said first diameter for a loose fit around said stem, a cylindrical sealing section positioned externally to said piston having an external diameter configured to slide into and fit snugly inside said nipple (5), said sealing section beginning at the bottom end of the piston and extending upwardly and terminating partway up the piston in the third section, said third section having a larger external diameter than, and extending radially relative to the sealing section thereby acting as a piston stop when in contact with said seat wherein said piston (3) is configured to slide up during operation of said motor such that the first section engages with said upper lock nut (1) to cause said piston (3) and said stem (2) to cooperate thereby exposing the fluid passage, and wherein said piston (3) is configured to downwardly slide into said nipple (5) such that said sealing section of said piston (3) slides into and engages the nipple (5) inside the fluid passage thereby creating an external seal of said fluid passage when said motor is not in operation.

7. The check valve of claim 6, wherein the stem (2) is configured to be coupleable at the stem top end to a motor and at the stem bottom end to a PCP rotor pump.

8. A check valve with an inertial mass for a progressive cavity pump (PCP), comprises:

a stem (2) having a stem top end and a stem bottom end;

an upper lock nut (1) removably coupled to said stem (2) below said stem top end;

a nipple (5) coupled around said stem (2) above said stem bottom end and exposing a fluid passage between said nipple (5) and said stem (2), said nipple (5) having a top end with a seat; and an elongated piston (3) slidably coupled around said stem below said upper lock nut and above said nipple, said piston having a locking section at a top end that is configured to engage with said upper lock nut (1), said piston having a short section abutting and below said locking section and having an aperture with a first diameter for a snug fit around said stem thereby providing an internal fluid seal between said piston and said stem, said piston further having an elongated section abutting and below said short section and extending to a bottom end of said piston, said elongated section having an axial length that is longer than the short section and an aperture with a second diameter larger than said first diameter for a loose fit around said stem, a cylindrical sealing section positioned externally to said piston and beginning at the bottom end of the piston and extending upwardly and terminating partway up the piston on the elongated section, said elongated section having a larger external diameter than, and extending radially relative to the sealing section thereby acting as a piston stop when in contact with said seat, wherein said sealing section comprises an external diameter configured to slide into and fit snugly inside said nipple (5) to create an external seal of said fluid passage.

9. The check valve of claim 8, wherein the stem (2) is configured to be coupleable at the stem top end to a motor and at the stem bottom end to a PCP rotor pump.

10. The check valve of claim 8, further comprising a lower nut (6) removably coupled to said stem (2) to provide support for coupling a rod string from a PCP rotor pump to said stem (2) at said stem bottom end.

11. The check valve of claim 8, wherein the short section comprises an internal packing material (17) configured to further enhance said internal fluid seal in said piston (3).

12. The check valve of claim 11, wherein said sealing section comprises an external packing material (18) for the external fluid seal when the sealing section is inside the nipple thereby preventing fluid from flowing through the nipple (5) in said fluid passage.

13. The check valve of claim 8, wherein said sealing section comprises an external packing material (18) configured for the external fluid seal when the sealing section is inside the nipple thereby preventing fluid from flowing through the fluid passage.

* * * * *